US005320394A

United States Patent [19]

Urbank

[11] Patent Number: 5,320,394

[45] Date of Patent: Jun. 14, 1994

[54] LIFT HARNESS FOR SMALL WATERCRAFT DEPLOYABLE BY ONE PERSON

[76] Inventor: Vincent A. Urbank, 609 Elizabeth Ave., Toms River, N.J. 08753

[21] Appl. No.: 157,310

[22] Filed: Nov. 26, 1993

Related U.S. Application Data

[63] Continuation-in-part of Ser. No. 930,332, Aug. 17, 1992.

[51] Int. Cl.[5] ..... B63C 7/00; B66C 13/02

[52] U.S. Cl. ..... 294/74; 114/44; 294/66.1

[58] Field of Search ..... 294/66.1, 67.4, 81.55, 294/74–77, 152–157; 5/81.1, 89.1, 625, 626; 114/44, 45, 48, 258, 259, 263, 365, 366, 376; 405/1, 3, 158; 441/35, 44, 80, 83, 87, 88, 129–134; 414/678

[56] References Cited

U.S. PATENT DOCUMENTS

| | | | |
|---|---|---|---|
| 1,325,025 | 12/1919 | Linnertz | 294/74 |
| 2,519,376 | 8/1950 | Jennings | 441/80 |
| 2,557,079 | 6/1951 | Cutri | 441/83 X |
| 3,176,327 | 4/1965 | Oberth | 441/83 |
| 3,383,721 | 5/1968 | Adams | 294/76 X |
| 3,421,165 | 1/1969 | Pugh | 294/77 X |
| 3,448,712 | 6/1969 | Lehmann et al. | 114/44 X |
| 3,622,025 | 11/1971 | Petersen | 294/74 X |
| 3,827,745 | 8/1974 | Pugh | 294/77 |
| 4,646,929 | 3/1987 | Plissonneau et al. | 441/80 X |

FOREIGN PATENT DOCUMENTS

| | | | |
|---|---|---|---|
| 3545533 | 7/1987 | Fed. Rep. of Germany | 294/81.55 |
| 286591 | 11/1990 | Japan | 294/67.4 |
| 92177 | 9/1959 | Netherlands | 294/74 |
| 1175790 | 8/1985 | U.S.S.R. | 294/74 |
| 446119 | 4/1936 | United Kingdom | 294/74 |
| 492127 | 9/1938 | United Kingdom | 294/74 |

*Primary Examiner*—Johnny D. Cherry
*Attorney, Agent, or Firm*—Charles I. Brodsky

[57] ABSTRACT

A lift harness for use in winching jet skis, boats and similar craft out from the water is described as including a pair of floatation pipes coupled to an overhead metal ring by a pair of fabric straps connecting the pipes and the ring in an "open-tent" configuration. In use, the floatation pipes in the water are manually held apart, the watercraft is guided between the pipes from behind, and the metal ring raised to a davit mechanically lifting the craft from the water in a construction where no metal parts contact the watercraft itself.

8 Claims, 1 Drawing Sheet

LIFT HARNESS FOR SMALL WATERCRAFT DEPLOYABLE BY ONE PERSON

This Application is a continuation-in-part of my Application Ser. No. 07/930,332, filed Aug. 17, 1992, and entitled "LIFT HARNESS".

FIELD OF THE INVENTION

This invention relates to a lift harness for watercraft, in general, and to such a harness which can be easily and safely used by a single person in deployment, in particular.

BACKGROUND OF THE INVENTION

As is well known and understood, lift harnesses are oftentimes employed for raising jet skis, boats and similar craft out from the water after use. Whether done at a boatyard, at a marina, or at the shoreline where the owner of the craft docks, such typical operations utilize a winching of the craft by means of metal connectors coupling with metallic rings provided at various points along the gunwales of the craft. Because the watercraft is not generally stationary, but is bobbing along at the water's edge, however, it oftentimes happens that scratches, gouges and similar such damage is done to the craft as one attempts to couple together the connector and ring configurations.

Additionally, and because of the bobbing about of the craft in the water, analysis has shown it to be tedious and bothersome, to continue to try to stretch the connector to couple onto the ring as the craft moves this way and that way. Because of this, it is not unusual to find that this winching operation of lifting the craft from the water requires two persons to effectuate-one, to try to hold the craft in position, and the other, to try to make the mechanical coupling of the connector to the ring.

SUMMARY OF THE INVENTION

As will become clear hereinafter, a lift harness is described according to the invention, which can be utilized and deployed by a single person in setting the watercraft for raising out from the water. In a preferred embodiment, a pair of floatation pipes are employed, coupled to an overhead metal ring by a pair of fabric straps which connect the pipes and ring in an "open-tent" configuration. In use, the floatation pipes in the water are manually held apart by the person deploying the harness, and the watercraft is guided between the pipes by that person from behind. The metal ring is then raised to a davit for mechanically lifting the craft from the water, and in a construction where no metal parts contact the watercraft itself.

In a preferred construction of the invention, a first fabric strapping is utilized to couple the metal ring and the floatation pipes at one end thereof into a first isosceles triangulation of the fabric, while a second fabric strapping is similarly employed to couple the metal ring and the floatation pipes at a second end in a further isosceles triangulation. By constraining the lengths of the sides of the two isosceles triangulations to be of substantially equal length, the portions of the straps which connect the pipes together at the base of the triangulations will be seen to be held apart by the pipes, and to support the watercraft which is floated in on top of them by the person guiding the craft into the "tent" configuration.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
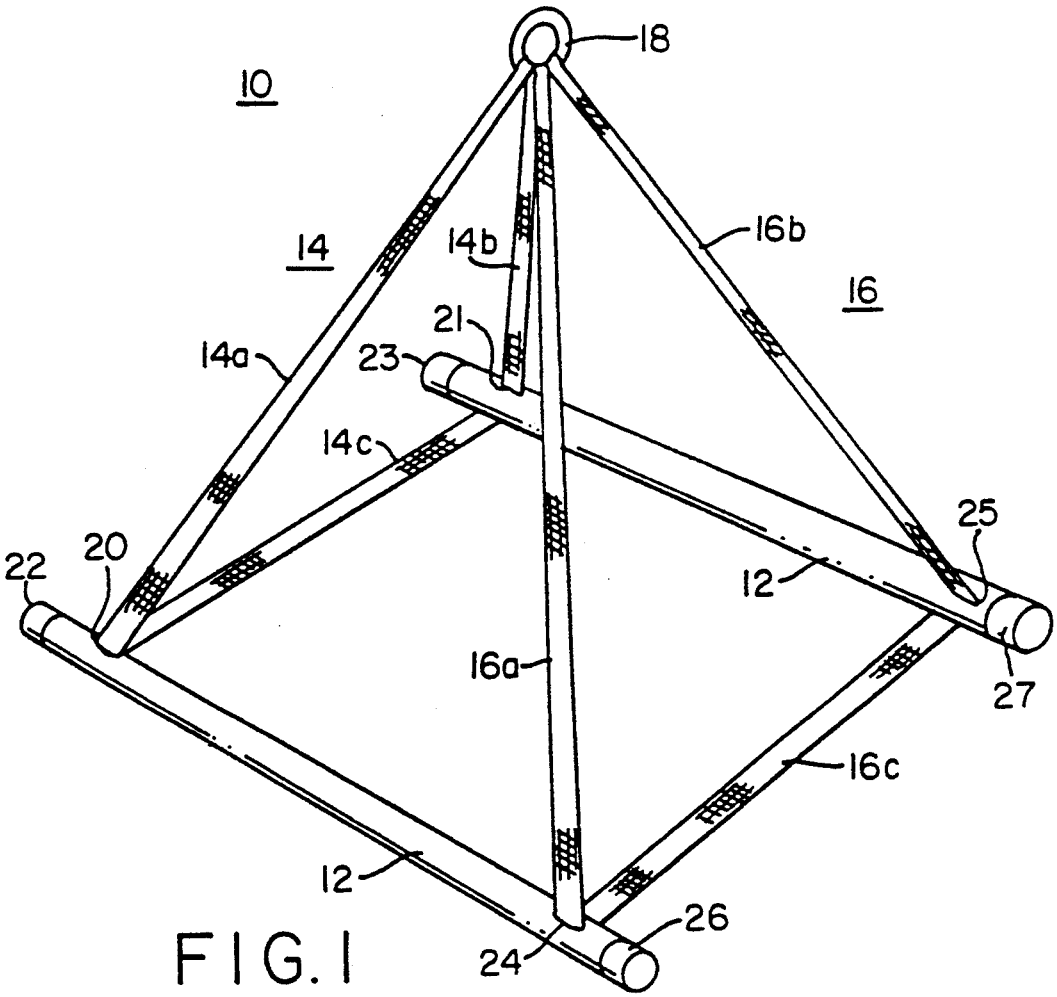
FIG. 1 shows a lift harness constructed in accordance with the teachings of the present invention.
Figure 2:
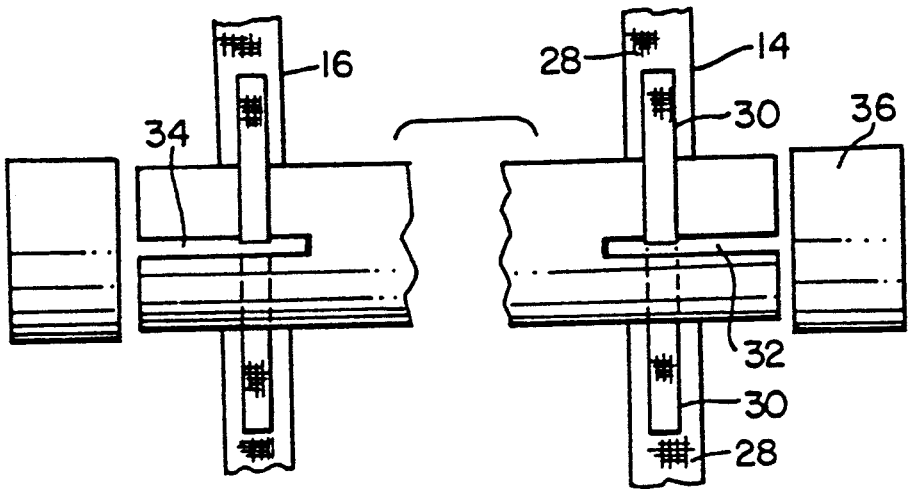
FIG. 2 is a partial, disassembled view illustrative of a manner in which the strappings of the invention are coupled to the floatation pipes in a preferred embodiment.

In FIGS. 1 and 2, the lift harness 10 of the invention is shown as employing a pair of floatation pipes 12, fabricated of a plastic, foam-filled composition such as polyvinylchloride, for example. Also shown is a pair of fabric strappings 14, 16-which, in alternative constructions may be composed of any type of non-metallic composition. A connector for the strappings 14, 16 is shown at 18, in the form of a metal ring, in a preferred embodiment. As illustrated in FIG. 1, the fabric strapping 14 may be understood to comprise three separate straps 14*a*, 14*b*, 14*c*, with the straps 14*a* and 14*b* being of substantially equal length, and respectively coupling the metal ring connector 18 to points 20, 21 of the pipes 12, which are located equidistant from their ends 22, 23. The strap 14*c* then joins the points 20, 21 together, to present a first isosceles triangulation for the harness when ready to be winched upward by a davit coupled to the connector 18.

Also illustrated, the fabric strapping 16 is composed of three separate straps 16*a*, 16*b*, 16*c*, with the straps 16*a*, 16*b* being constructed of substantially equal length. As indicated, the straps 16*a*, 16*b* extend from the metal ring connector 18 to connect at points 24, 25 on the pipes 12, each equidistant from their ends 26, 27 -- thereby forming a second isosceles triangulation of the strapping 16. The third strap in this configuration, 16*c*, will be noted to join the points 24, 25 -- similarly forming a base to lift any watercraft that may be guided onto the straps 14*c*, 16*c* by the person guiding the craft into the harness for winching. In a preferred embodiment of the invention, each of the straps 14*a*, 14*b*, 16*a* and 16*b* are selected of substantially the same length, and the points 20, 21 and the points 24, 25, are each selected to be the same distance away from their respective ends 22, 23 and 26, 27. With the strappings 14, 16 being composed of a fabric composition, it will be readily apparent that the only component of the harness constructed of "metal" is the connector ring 18. As will also be understood, to facilitate an "open-tent" configuration for the watercraft to be guided in, and between the floatation pipes 12 to be adequately held in place while the winching is accomplished, the straps 14*c* and 16*c* are likewise selected of substantially equal length.

FIG. 2 more specifically shows a preferred embodiment of the invention, in which the fabric strappings 14, 16 are shown as comprised of a two-layer construction 28, 30 at the points of connection to the pipes 12. Additionally, the ends of the pipes 12 are shown "slotted", as at 32, 34, and with the second layer 30 passing through the slots 32, 34, so as to be stitched to the layer 28 in being held in position. A cap 36 seals-off the pipe 12, in holding the foam-filling in position in giving the floatation characteristic to the pipes. Although not shown in such detail, it will be appreciated that this type of construction, slotting, and capping, will exist at each of the four ends 22, 23, 26 and 27.

In use, all that is required is to float the pipes 12 in the water, and for the person guiding-in the watercraft to merely spread-apart the pipes 12 the distance allowed by the lengths of the straps 14*c*, 16*c*. The metal ring connector 18 is then lifted out-of-the-way, and the watercraft floated in atop the straps 14*c*, 16*c* by guiding the craft in from behind, through the "open-tent" configurations formed by the two isosceles triangulations. Of course, different length strappings would be required to accommodate different size jet skis, boats or other craft – and actual construction has shown that all that is required is to provide a total area that is approximately only one foot more than the craft needs to be floated in easily, yet be held in place thereby when it becomes time for the winching to follow. Whatever the lengths of the strappings 14, 16 — or of the individual straps 14*a*, 14*b* and 14*c*, and 16*a*, 16*b* and 16*c* if six separate straps are utilized —, actual construction has shown that all that is needed is to properly select the lengths required, with pipes 12 only of a 2½ foot length being sufficient to handle all foreseeable sizes. With the davit hooked to the metal ring connector 18 in all these instances, manual winching then simply raises the craft from the water, and no metallic banging, or clanging results so as to damage the craft.

In operation, with the watercraft floated onto the straps 14*c*, 16*c* its weight tends to pull the straps 14*c* and 16*c* downward, and to pull the pipes 12 under the water. However, because of the greater buoyancy of the foam-filled pipes as contrasted with that of the watercraft, the pipes 12 continue to float and exert an upward pull on the straps 14*c*, 16*c*, holding them fast against the bottom of the craft. In similar manner, the downward force created by the weight of the boat then pulls the floatation pipes 12 against the sides of the craft at the water level. The end result is that the watercraft is held secured in the harness even while the craft may be bobbing about in the water, and/or under wind conditions otherwise having a tendency to blow it about. The user can then simply actuate the winch to raise the cable whose hook was secured this whole time to the connector ring 18, in lifting the craft from the water.

When it becomes time to place the watercraft back, the cable is lowered, but the bouyancy of the foam-filled floatation pipes 12 continues to prevent the harness from floating away from the craft until the user reaches out to grab the floatation pipes, and move them forwardly or rearwardly away from the craft itself.

As will be understood, this inclusion of the foam-filled pipes and preselected fabric lengths enables the watercraft to be deployed by one person, as contrasted with prior art harnesses where one person is required to guide the craft into position, and to hold it there while it may be floating about, until a second person is able to obtain just the right tension on the winch cable to hold the harness in place. With such arrangements, if one person were to try to perform both functions, while the cable tension of the winch is being adjusted, the watercraft may well float away.

While there have been described what are considered to be preferred embodiments of the present invention, it will be readily appreciated by those skilled in the art that modifications can be made without departing from the scope of the teachings herein. For at least such reasons, therefore, resort should be had to the claims appended hereto for a true understanding of the scope of the invention.

I claim:

1. A lift harness for small watercraft, deployable by one person, comprising:

a pair of floatation pipes having first and second opposite ends;

a single connector;

first and second fabric straps respectively coupling said connector to said pair of floatation pipes at a point adjacent to said first ends thereof;

third and fourth fabric straps respectively coupling said connector to said pair of floatation pipes at a point adjacent to said second ends thereof;

a fifth fabric strap coupled between said pair of floatation pipes at said point adjacent to said first ends; and a sixth fabric strap coupled between said pair of floatation pipes at said point adjacent to said second ends;

with said first, said second, said third and said fourth straps being selected of substantially equal length, and with said fifth and said sixth straps being also selected of substantially equal length;

with said pair of floatation pipes being fabricated of a plastic, foam-filled composition; and with the areas defined by said first, said second and said fifth straps and by said third, said fourth and said sixth straps being only slightly greater than the area required to encompass a watercraft resting on said fifth and sixth straps when deployed.

2. The lift harness of claim 1 wherein said first and second straps respectively couple said connector to said pair of floatation pipes at points thereon equidistant from said first ends thereof.

3. The lift harness of claim 2 wherein said third and fourth straps respectively couple said connector to said pair of floatapipes at points thereon equidistant from said second ends thereof.

4. The lift harness of claim 1 wherein said first, second and fifth straps together comprise a first single strap of fabric material.

5. The lift harness of claim 4 wherein said third, fourth and sixth straps together also comprise a second single strap of fabric material.

6. The lift harness of claim 5 wherein said first and second single straps of fabric material are of two layer construction at points of coupling to said pipes, with the layers thereof separated in looping around said floatation pipes to secure thereto at said points adjacent to said first and second ends, respectively.

7. A lift harness of claim 1 wherein said connector is fabricated of a metal composition.

8. The lift harness of claim 7 wherein said pair of floatapipes are fabricated of a polyvinylchloride foam-filled composition.

* * * * *